US005540361A

United States Patent [19]

Fattori

[11] Patent Number: 5,540,361

[45] Date of Patent: Jul. 30, 1996

[54] CREAM DEDORANT DISPENSER

[75] Inventor: Joseph E. Fattori, Mendham, N.J.

[73] Assignee: The Mennen Company, Morristown, N.J.

[21] Appl. No.: 327,836

[22] Filed: Oct. 27, 1994

[51] Int. Cl.[6] ..... B65D 83/00

[52] U.S. Cl. ..... 222/390; 401/175

[58] Field of Search ..... 222/330, 340, 222/390, 391, 206, 407, 386; 401/68, 75, 174, 175

[56] References Cited

U.S. PATENT DOCUMENTS

| | | | |
|---|---|---|---|
| 642,082 | 1/1900 | Carter | 222/390 |
| 1,312,912 | 8/1919 | Kimball | 222/390 |
| 1,663,338 | 3/1928 | Gagne | 222/390 |
| 1,803,524 | 5/1931 | Davis | 222/256 |
| 2,233,587 | 4/1941 | Crewe | 222/391 |
| 2,276,722 | 3/1942 | Hillman et al. | 401/175 |
| 2,371,332 | 9/1942 | Jacobson | 222/386 |
| 2,568,856 | 9/1951 | Hartmann | 222/390 |
| 2,917,765 | 12/1959 | Jakubowski | 401/175 |
| 2,923,442 | 2/1960 | Maras | 222/327 |
| 2,998,167 | 8/1961 | Boehm | 222/320 |
| 3,078,011 | 2/1963 | Safianoff | 222/390 |
| 3,121,905 | 2/1964 | Shapiro | 401/175 |
| 3,756,730 | 9/1973 | Spatz | 401/174 |
| 4,009,804 | 3/1977 | Costa et al. | 222/391 |
| 4,019,654 | 4/1977 | van Manen | 222/1 |
| 4,030,643 | 6/1977 | van Manen | 222/386 |
| 4,122,983 | 10/1978 | Jolly | 222/390 |
| 4,126,251 | 11/1978 | Subwick | 222/326 |
| 4,221,490 | 9/1980 | Malm | 401/29 |
| 4,264,021 | 4/1981 | Davis, Jr. | 222/326 |
| 4,356,938 | 11/1982 | Kayser | 222/327 |
| 4,456,450 | 6/1984 | Heling | 222/391 |
| 4,461,407 | 7/1984 | Finnegan | 222/391 |
| 4,595,124 | 6/1986 | Duval et al. | 222/390 |
| 4,624,594 | 11/1986 | Sasaki et al. | 401/176 |
| 4,681,524 | 7/1987 | Ikeda et al. | 222/391 |
| 4,702,398 | 10/1987 | Seager | 222/386 |
| 4,778,300 | 10/1988 | French et al. | 401/55 |
| 4,923,096 | 5/1990 | Ennis, III | 222/391 |
| 5,000,356 | 3/1991 | Johnson et al. | 222/391 |

FOREIGN PATENT DOCUMENTS

| | | |
|---|---|---|
| 0109982 | 12/1982 | European Pat. Off. . |
| 0100204 | 7/1983 | European Pat. Off. . |
| 2203031 | 3/1988 | United Kingdom . |

*Primary Examiner*—Andres Kashnikow
*Assistant Examiner*—Philippe Derakshani
*Attorney, Agent, or Firm*—Antonelli, Terry, Stout & Kraus

[57] ABSTRACT

Described is a dispensing package for a flowable viscous product which can relieve residual pressure on the product in the package, so as to avoid product weeping out of the package. The package uses an elevator to force product out of the package, the elevator including resilient structure to spring-bias the elevator in a direction away from the product outlet of the package. After dispensing the desired amount of product, this spring bias retracts the elevator so as to relieve residual pressure. Also described is structure for moving the elevator which provides both axial movement and reciprocating axial movement, without creating difficulty for the consumer to cause elevator movement between the first and second portions.

45 Claims, 12 Drawing Sheets

CREAM DEDORANT DISPENSER

BACKGROUND OF THE INVENTION

The present invention is directed to a dispensing package, particularly for dispensing a flowable viscous material. More particularly, the present invention is directed to a dispensing package for dispensing a cream product, such as a cream deodorant or cream antiperspirant product, for application to axillary regions of the human body.

Dispensing packages, for dispensing cream products, such as cream deodorant or cream antiperspirant products, are known. Typically, the product is extruded out of an outlet (for example, outlet slots) in a top end of the dispensing package, by manually turning a hand wheel (thumb wheel), which drives a feed screw and, in turn, an elevator. Moving the elevator decreases the volume of an interior chamber of the dispensing package which contains the product; this pressurizes the product, causing the product to be extruded through the outlet slots onto an applicator surface desirably forming the top end of the dispensing package.

A problem with this type of dispensing package is a weeping of the product onto the applicator surface, after a desired amount of the product has already been dispensed from the package. Such weeping is caused due to residual pressure on the product in the interior chamber of the dispensing package, after the desired amount of the product has been extruded through the outlet.

An approach to solving this problem of weeping of product onto the applicator surface is described in U.S. Pat. No. 5,000,356 to Johnson, et al, the contents of which are incorporated herein by reference in their entirety. Briefly, the dispensing package disclosed in U.S. Pat. No. 5,000,356 includes a container body which has a uniform cross-sectional interior chamber to hold the product. The container body has a lengthwise central axis, an elevator congruent to and which axially moves within the container body, forming a movable surface of the interior chamber, and a feed screw to cause the elevator to advance axially forward while axially reciprocating the elevator one cycle for each increment of forward motion. The aforementioned weeping is avoided by providing the reciprocating movement of the elevator, superimposing axial reciprocative displacement onto the unidirectional axial advance of the elevator. By providing the reciprocating displacement of the elevator, the elevator automatically can be retracted from the product in the interior chamber upon dispensing of product (that is, the volume of the interior chamber can be increased), thereby relieving the residual pressure caused by the forward stroke of the elevator.

U.S. Pat. No. 5,000,356 discloses structure for providing the reciprocating displacement, including a camming surface of the bottom of the container body and a corresponding follower surface fixed to the feed screw. This U.S. Pat. No. 5,000,356 discloses providing a biasing spring between the thumb wheel and the feed screw on which the elevator is provided, to bias the feed screw (and elevator) away from the product, thereby forcing retraction of the elevator from the product (on the camming surface of the bottom of the container body). Moreover, this U.S. Pat. No. 5,000,356 discloses that the camming surface on the container, as well as the follower fixed to the feed screw, should each be a sawtooth structure.

However, various problems arise in connection with the structure disclosed in U.S. Pat. No. 5,000,356. A relatively weak spring action is provided biasing the feed screw toward the camming surface of the container body, for reciprocatingly drawing the elevator away from the product. According to the structure in U.S. Pat. No. 5,000,356, wherein the spring action is provided between the feed screw and thumb wheel, such spring action must overcome friction between the elevator and container sides; this acts as a limit on the seal which can be utilized between the elevator and container sides. Because the spring action is relatively weak, the elevator must be relatively loosely fitting against the sides of the container body, so that the spring can be effective in forcing the follower downward against the camming surface. However, with such relatively loose fit of the elevator in the container body, the problem arises that the product can leak out of the interior chamber, between the sides of the container body and the elevator. A further problem arises in that the sawtooth camming surface and sawtooth follower make it difficult to turn the thumb wheel so as to propel the elevator toward the product while providing reciprocating movement of the elevator, and especially makes it difficult to retract the elevator axially (that is, to turn the thumb wheel in a direction opposite to that causing the forward stroke).

Accordingly, it is still desired to provide a dispensing package for flowable viscous products (for example, for a cream deodorant or antiperspirant product), wherein leakage (either weeping onto an applicator surface or leakage between sides of the container body and the elevator) from the package is avoided, while the product can easily be applied from the dispensing package by a consumer.

SUMMARY OF THE INVENTION

Accordingly, it is an object of the present invention to provide a dispensing package, e.g., for a flowable viscous product, such as an antiperspirant or deodorant cream, to provide the packaged product, wherein leaking of product from the package is avoided, and to provide a method of using the package to dispense product.

It is a further object of the present invention to provide a dispensing package, and packaged product, wherein the product can easily be dispensed from the package by a consumer, and a method of using such package and packaged product.

It is a still further object of the present invention to provide a dispensing package for a flowable viscous product, wherein leaking of product between the elevator and sides of the container is avoided.

It is a still further object of the present invention to provide a dispensing package for a flowable viscous product, wherein weeping of product onto the applicator surface through the outlet from the package, after desired dispensing of product from the package has ended, is avoided.

It is a still further object of the present invention to provide a dispensing package which is easy to use and which dispenses a consistent amount of product for desired application (for example, where the product is an antiperspirant or deodorant product, which delivers a consistent amount of product onto an applicator surface for application to axillary regions of a human body).

It is a still further object of the present invention to provide a dispensing package for an antiperspirant or deodorant product (for example, a cream, a soft solid, etc.), wherein leaking of product from the package is avoided, yet wherein the package can easily be used to dispense product for application to the axillary region of a human body.

The foregoing objects are achieved through various aspects of the present invention, described in the following. The descriptions are illustrative of the present invention and are not limiting, the present invention being defined by the appended claims.

The dispensing package of the present invention includes an interior chamber containing the product to be dispensed. One of the surfaces of the interior chamber is defined by an elevator, the elevator moving so as to decrease volume of the interior chamber in order to force product out of the interior chamber in order to dispense the product (for example, forcing the product out of the interior chamber onto an applicator surface at a top end of the package). The elevator includes a resilient structure (for example, a spring element), which biases the elevator so as to cause a slight increase in volume of the interior chamber of the package after dispensing of product has ceased. Specifically, the elevator has first and second portions and a resilient structure. During dispensing of product, the first portion of the elevator moves a greater distance than the second portion while decreasing the volume of the interior chamber. After dispensing of product has stopped, the resilient structure acts to draw the first portion back toward the second portion, thereby slightly increasing the volume of the interior chamber; this automatically relieves the residual pressure on the product in the interior chamber, so that weeping of product caused by the residual pressure can be avoided. Moreover, by forming the resilient structure as part of the elevator, a relatively tight seal can be used between the elevator and the sides of the interior chamber, so that leakage between the elevator and sides can be avoided, while still being able to achieve sufficient biasing action to increase the interior chamber volume and avoid product weeping.

According to this aspect of the present invention, desirably the elevator has an elevator cup forming the movable surface of the interior chamber, and the elevator cup includes a spring element which preferably forms an integral part of the elevator cup.

According to this aspect of the present invention, since the resilient structure is formed as part of the elevator, a relatively strong spring biasing action can be achieved substantially independent of the seal between the elevator and container body sides. Accordingly, the need for spring biasing does not act as a limitation on the ability to provide a seal between the interior chamber sides and the elevator. Moreover, due to providing the resilient structure as part of the elevator, the resilient structure acts to relieve residual pressure on the product (and also helps provide a seal for the interior chamber), independent of, for example, additional structure of the dispensing container (for example, independent of a need for a spring between the thumb wheel and feed screw as in U.S. Pat. No. 5,000,356).

The dispensing package of the present invention, according to other aspects, has structure wherein the elevator can easily be moved to reduce the volume of the interior chamber (provide a forward stroke), for dispensing product from the dispensing package, and to provide reciprocating movement of the elevator. One aspect includes a follower on the feed screw and a camming surface on the container body (bottom), for providing the reciprocating motion of the feed screw, but uses a rounded camming surface on the container body and a rounded follower, rather than the sawtooth surfaces as in U.S. Pat. No. 5,000,356. Utilizing such rounded surfaces, the rotation of the thumb screw, to extrude the product and especially to retract the elevator, is facilitated (that is, it becomes easier to rotate the thumb wheel), as compared to use of sawtooth surfaces as in U.S. Pat. No. 5,000,356.

According to a still further aspect of the present invention, rather than using a conventional feed screw, the structure for causing the elevator to move (for example, in order to decrease the volume of the interior chamber) includes a member having a helical track, with the elevator being moved by a follower which follows this helical track. As, for example, the helical track is rotated, the follower moves thereon, causing the elevator to move, thereby causing a forward stroke of the elevator and reducing the volume of the interior chamber. The helical track follows a serpentine path, having, e.g., cyclic high and low points along the helical track. Following the serpentine path, the elevator moves both in a direction to dispense product (that is, moves to reduce the volume of the interior chamber, so as to force product out of the interior chamber) and in a reciprocating movement, so as to relieve the residual pressure discussed previously.

The dispensing package of the present invention is particularly appropriate for use in connection with a flowable viscous product (for example, a cream product, such as an antiperspirant or deodorant cream or soft solid). Illustratively, but not limiting, the flowable viscous product has a viscosity of 500,000–2,000,000, preferably 1,000,000–1,500,000, cps. However, the present invention is not limited to antiperspirant and/or deodorant products, and can be utilized to dispense various other products known in the art.

Accordingly, through use of the present invention, a tight seal can be achieved between the elevator and sides of the interior chamber containing the product, while still avoiding weeping of product from the outlet of the package. Leakage of product between the sides of the container and the elevator can be avoided, since a much better seal between the sides and elevator can be utilized. According to the present invention, the spring action is provided as part of the elevator, so that there is no need to take into account the spring action in providing the seal between the elevator and container sides (a limitation on such seal, according to the present invention, being that such seal preferably is not so tight that there is difficulty in turning the thumb wheel in raising the elevator so as to force product out of the dispensing package).

Moreover, through use of the present invention, a dispensing package is achieved which is easily used by the consumer to dispense product, and wherein generally consistent amounts of product can be dispensed.

BRIEF DESCRIPTION OF THE DRAWINGS

FIG. 6 being a sectional view along line VI—VI of FIG. 5; FIG. 7 being a sectional view along line VII—VII of FIG. 5; and FIG. 8 being an enlarged sectional view of the resilient structure of the elevator cup.

FIG. 10 being a sectional view along line X—X of FIG. 9; and FIG. 11 being a sectional view along line XI—XI of FIG. 9.

FIG. 15 being a sectional view along line XV—XV of FIG. 14; and FIG. 16 being a sectional view along line XVI—XVI of FIG. 14.

DETAILED DESCRIPTION OF THE INVENTION

While the invention will be described in connection with specific and preferred embodiments, it will be understood that it is not intended to limit the invention to those embodiments. On the contrary, it is intended to cover all alterations, modifications and equivalents as may be included in the spirit and scope of the invention as defined by the appended claims.

Throughout the present description, where it is disclosed that the structure and/or method include or comprise specific components or steps, it is also within the contemplation of the present invention that the apparatus and/or method consist essentially of, or consist of, the recited components or steps.

The present invention, in its specific embodiments, is described in terms of a dispensing package for a deodorant and/or antiperspirant cream (soft solid), having an applicator surface for applying the cream to axillary regions of the human body. The present invention is not intended to be limited to this applicator surface and this use, it being contemplated by the inventor that the dispensing package of the present invention can be used generally for materials such as flowable viscous materials, with appropriate applicator surfaces (or with no applicator surface).

Figure 1:
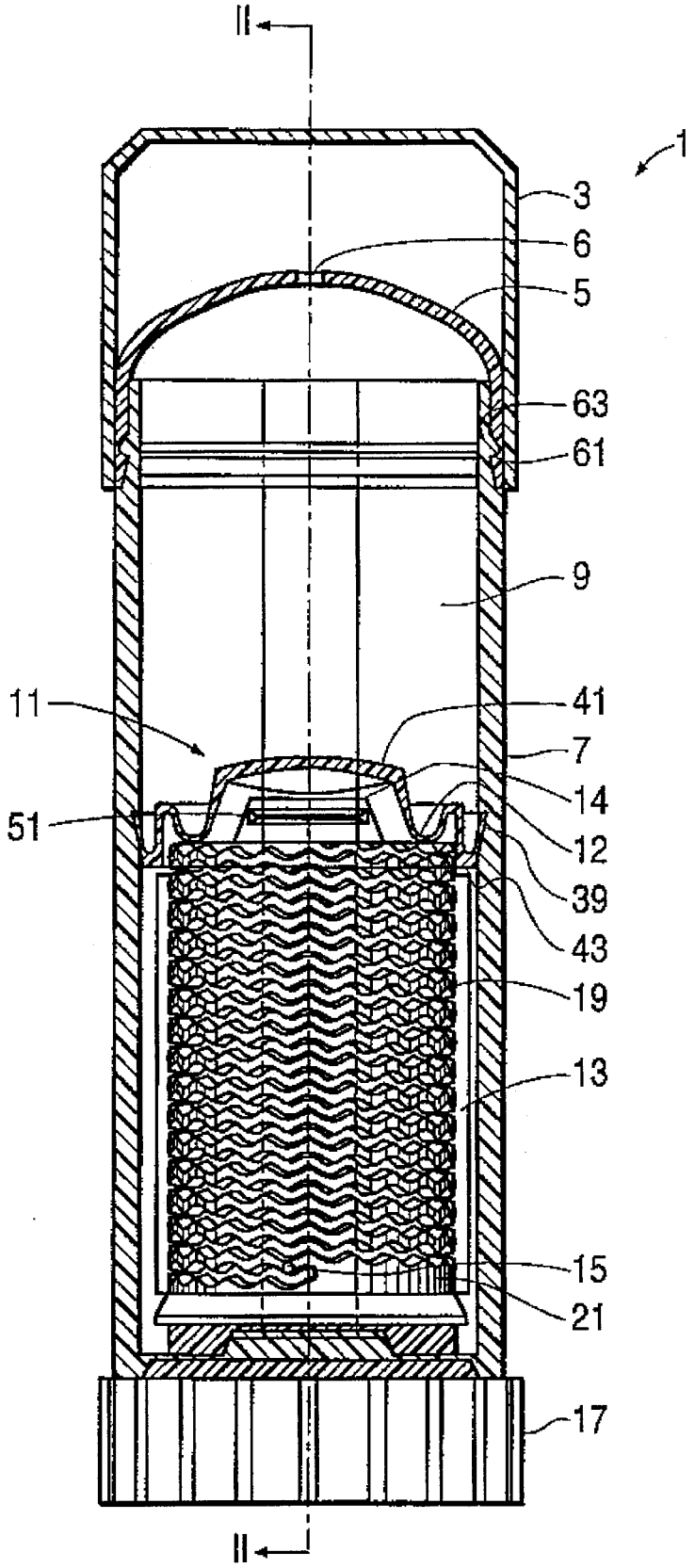
FIG. 1 is a sectional view of a first embodiment of the present invention.
Figure 2:
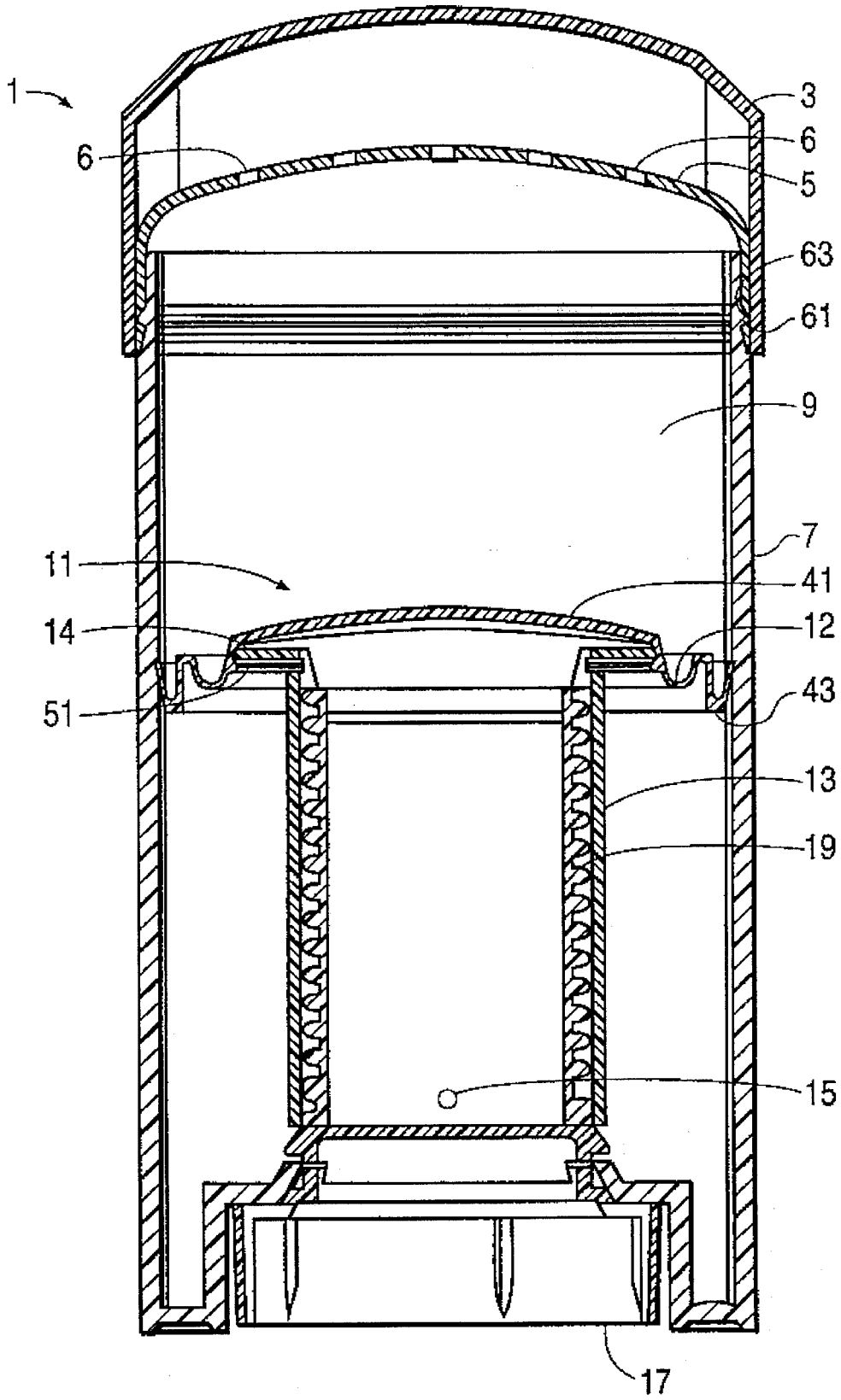
FIG. 2 is a vertical section along line II—II of FIG. 1.

A first embodiment according to the present invention is shown most generally in FIGS. 1 and 2, with various details thereof shown more specifically in FIGS. 3–11. In FIGS. 1 and 2 are shown dispensing package 1, comprised of a cap 3 and container 7. The cap 3 covers the applicator surface 5 covering the open upper end of the container 7. The applicator surface 5 can be snap-fit on container 7, with projection 61 on container 7 fitting into a corresponding indentation 63 in applicator surface 5. Sides of the container 7, the applicator surface 5 and elevator cup 11 form interior chamber 9 of the dispensing package, where the product is stored. A seal is provided between elevator cup 11 and sides of the container 7, at a position represented by reference character 39 in FIG. 1.

Also shown in FIGS. 1 and 2 is elevator member 13 having followers 15 thereon. In this embodiment of the present invention the elevator member 13 has a cylindrical form and fits over rod member 21 having a helical track 19 forming a serpentine path; followers 15 on an inner surface of elevator member 13 follow the helical track upon rotation of rod member 21. In the embodiment shown in FIGS. 1–11, the elevator member has 4 followers 15, as seen most clearly in FIG. 9; however, the present invention is not limited thereto, and the elevator member can have any number of followers thereon, as long as they are positioned so that all are in the "up" position or all are in the "down" position, at the same time. Elevator member 13 includes surface 14 (see FIGS. 2 and 9–11) interfacing with the elevator cup 11.

Figure 3:
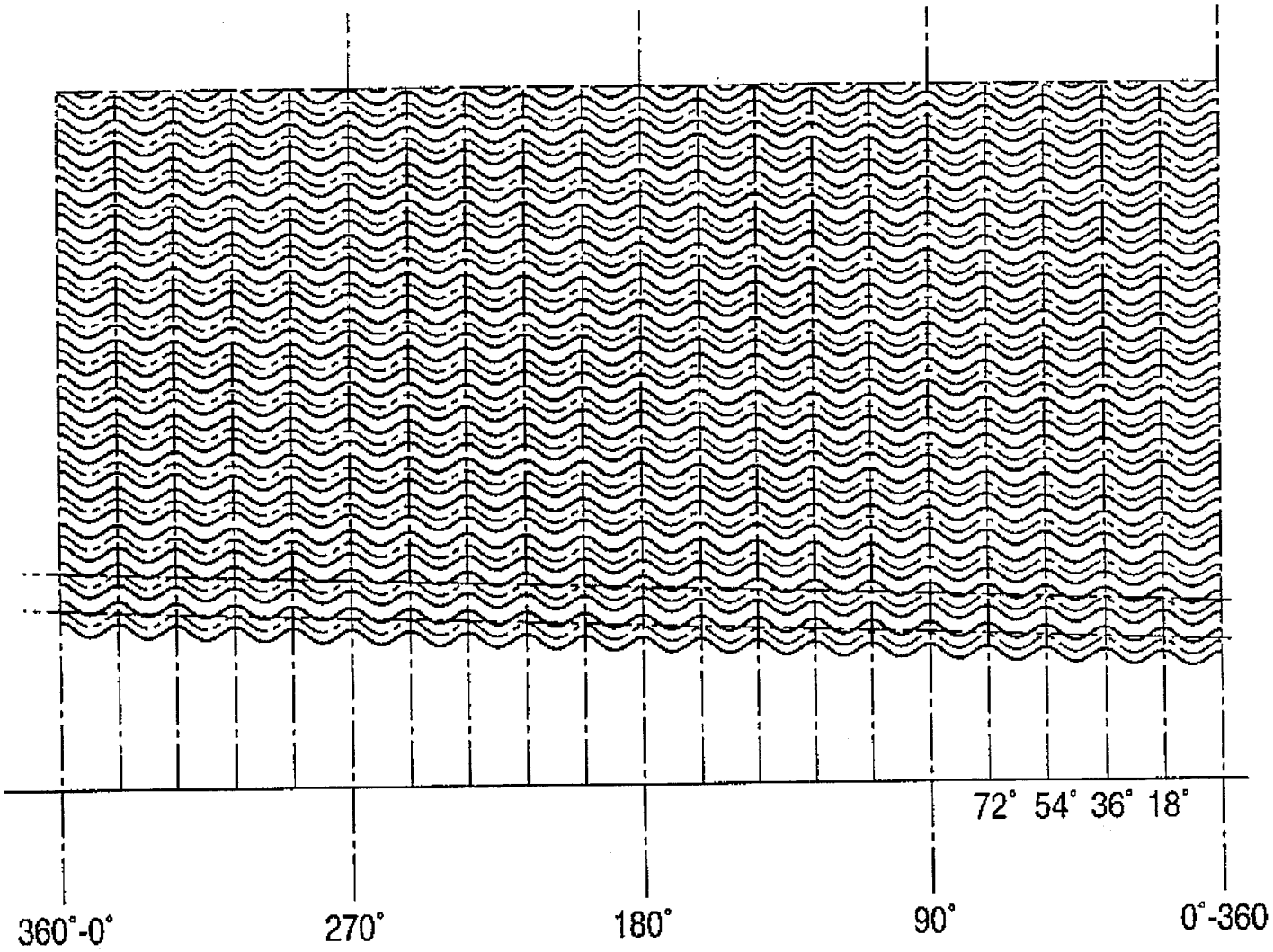
FIG. 3 shows the helical track having a serpentine path, of this first embodiment of the present invention.
Figure 4:
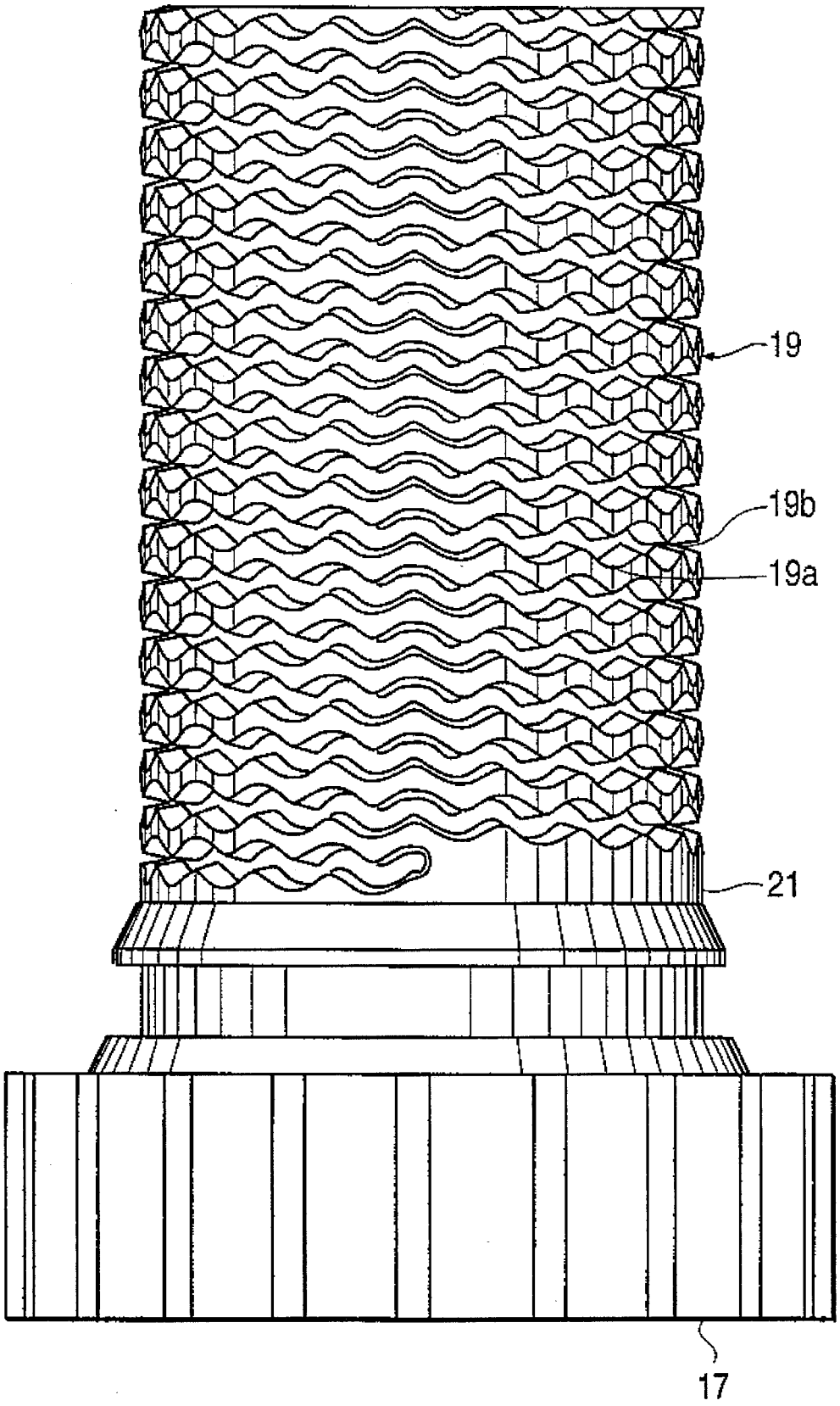
FIG. 4 shows in detail the structure with the helical track having the serpentine path.
Figure 5:
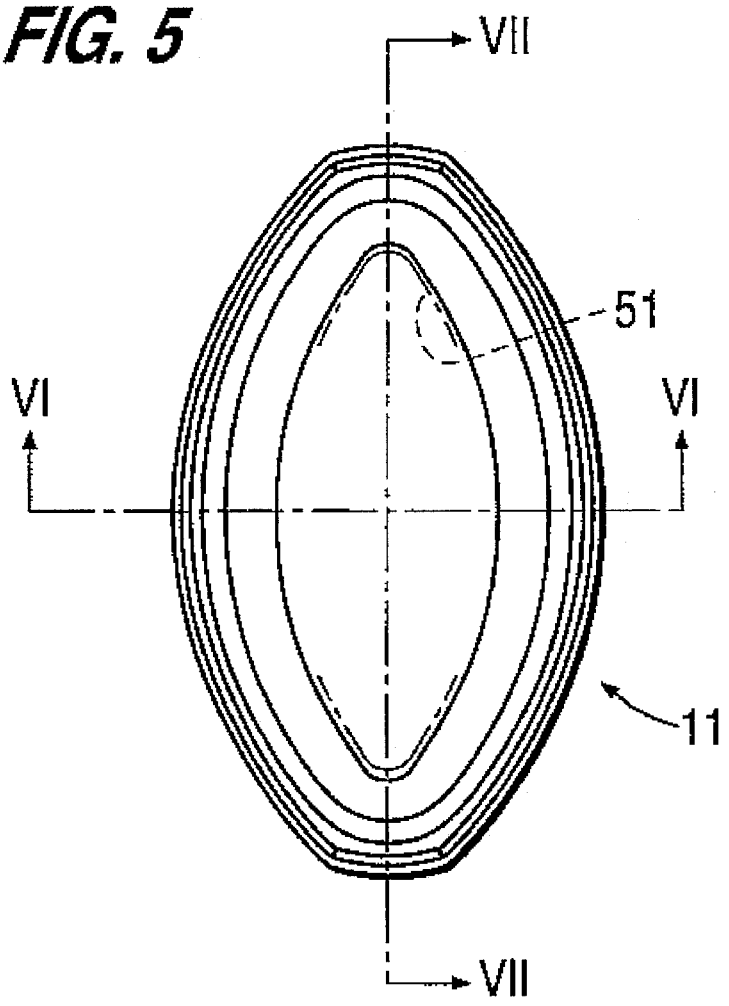
FIGS. 5–8 show the elevator cup according to the present invention, with FIG. 5 showing a bottom view of the elevator cup.

Also shown in FIG. 1, and shown in more detail in FIGS. 3 and 4, is the helical track 19 having a serpentine path, upon which the followers 15 ride. The helical track 19 is provided on rod member 21 (see, especially, FIG. 4), and rod member 21 is, e.g., molded as one piece with thumb wheel 17 (the integral rod member/thumb wheel being snap-fitted into the container). As can be appreciated, the helical track has a pitch such that, upon rotation of the helical track in the appropriate direction, the elevator member 13 rises, pushing (at surface 14 of the elevator member 13) the elevator cup 11 upwards, thereby forcing product out of the outlet 6 in applicator surface 5 for dispensing the product. The helical track 19 is rotated by rotating thumb wheel 17, exterior of container 7. As seen most clearly in FIGS. 3 and 4, the serpentine path of the helical track has low points **19*a* and high points 19*b*, relative to the bottom of the helical track (low points being closer to the thumb wheel). Low points and high points alternate, so as to provide reciprocating motion to the elevator member and hence to the elevator cup. As seen in FIG. 3, the serpentine path is in the form of a sine wave, and repeats itself every 18°. Illustratively, the helical track has a pitch of 0.100 inch, where the rod member 21** has a diameter of 1.00 inch.

The elevator cup 11, forming the bottom of interior chamber 9 in this first embodiment of the present invention, is shown in more detail in FIGS. 5–8. This elevator cup includes spring element 12, between first portion 41 and second portion 43 of elevator cup 11. The elevator cup can be made of a resin, for example, linear low density polyethylene. However, the elevator cup is not limited to such polyethylene as construction material, but can be made of other materials such as ethylene vinyl alcohol, Kraton, etc. A desirable feature of the elevator cup is that it must include resilient structure, to provide the aforementioned spring action, which does not absorb materials (such as silicones) from the product (for example, deodorant and/or antiperspirant cream product).

Figure 7:
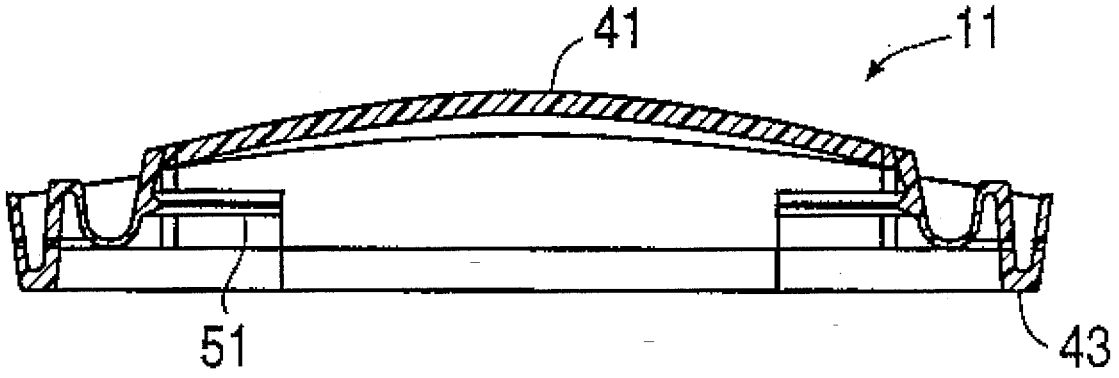
Figure 8:
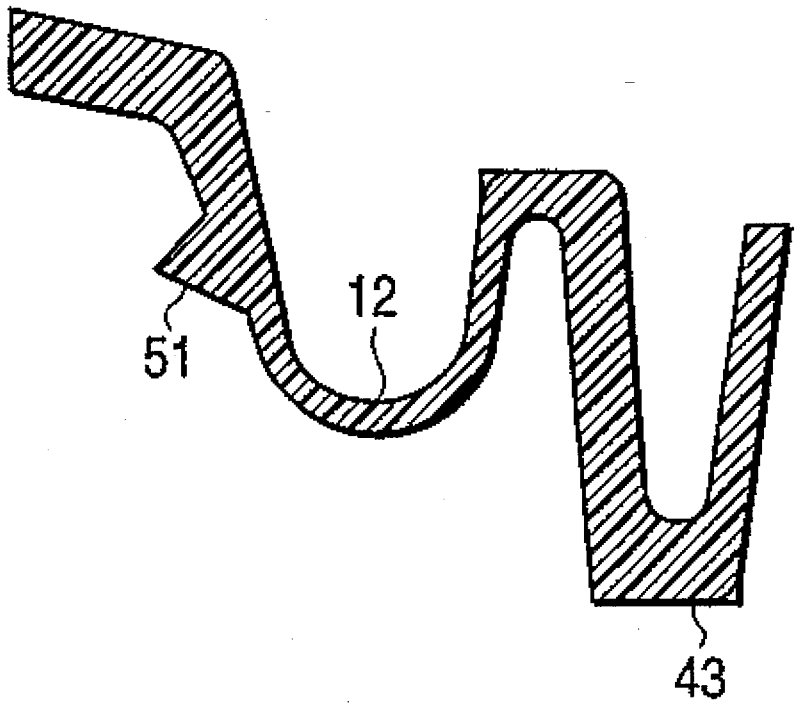
Figure 11:
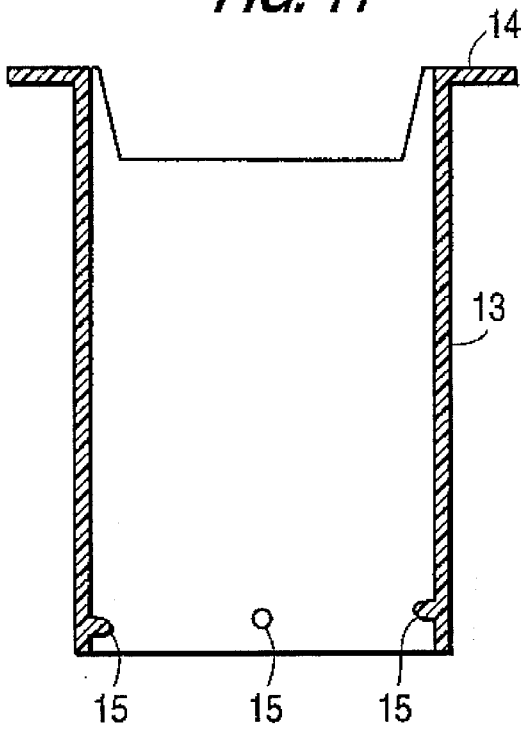
FIGS. 9–11 show the elevator member of the first embodiment of the present invention, with FIG. 9 being a top view.
Figure 9:
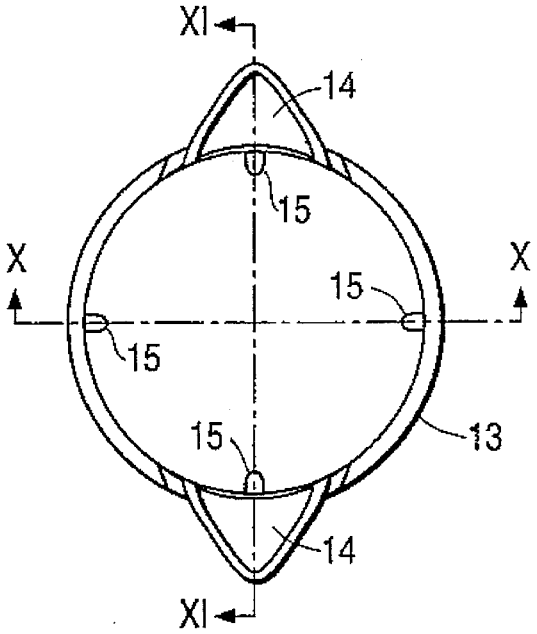
Figure 10:
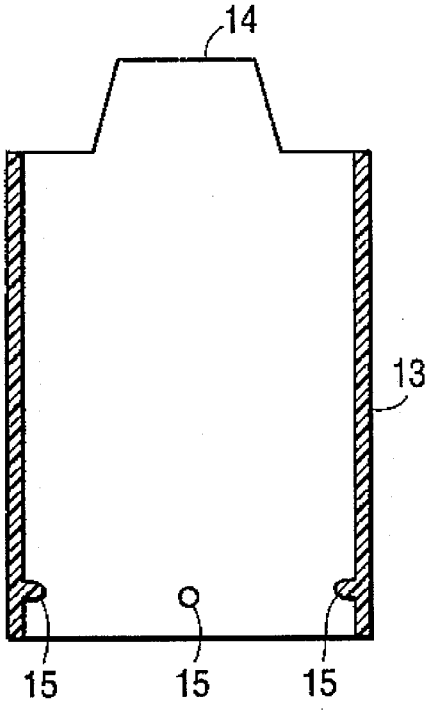

The resilient structure providing the spring biasing action is shown in greater detail in FIG. 8. This structure is illustrative, and not limiting. In this figure, the spring biasing action is provided by a U-shaped part of the elevator cup 11, forming an integral part of the elevator cup 11. The elevator cup can be formed by molding, e.g., of a single material (illustrative materials having been mentioned previously). Of course, the elevator cup 11 has a memory of its shape as shown in FIGS. 5–8; during the forward stroke, in dispensing product, the elevator cup 11 is forced out of shape, but the elevator cup 11 returns to this shape after ending the forward stroke, providing the spring biasing action.

Figure 6:
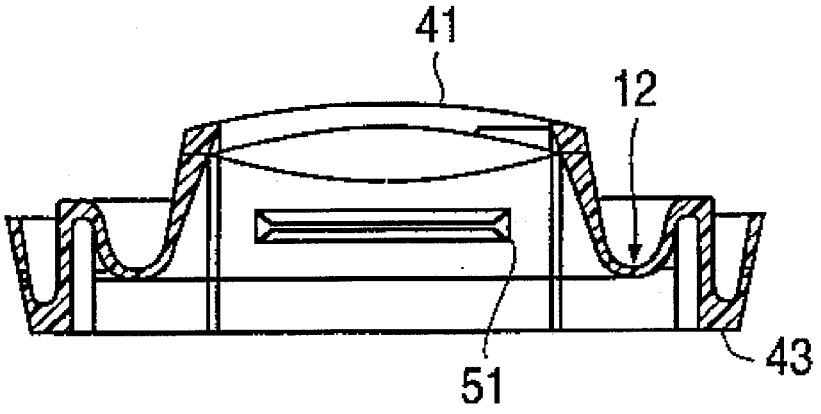

Also shown in FIGS. 6–8, for example, is retaining member 51 for retaining the elevator member 13 against the elevator cup 11. For example, retaining member 51 is a lip which holds a surface 14 of the elevator member.

In use, the consumer will remove cap 3, and then turn thumb wheel 17 in the appropriate direction. Turning thumb wheel 17 causes rotation of the helical track, thereby causing relative movement between the helical track and the followers 15 on elevator member 13. Upon rotating the helical track in the proper direction, the followers 15 will move in a generally upward direction, causing the elevator member 13 to move upwardly and cause surface 14 thereof to force up elevator cup 11. Further rotation of the thumb wheel causes the elevator member 13 to push the elevator cup 11 upwards, thereby forcing the product out of outlet 6 (which can be, for example, a series of slots in the applicator surface 5) onto applicator surface 5, for application, for example, to axillary regions of the human body where the product is an antiperspirant and/or deodorant cream.

The elevator member 13 contacts the elevator cup at surface 14 and pushes up the first portion 41 of elevator cup 11. Due to resilient member 12, the first portion 41 will move first and moves a greater distance than the second portion 43; moreover, due to the resilient member 12, upon pushing up the elevator cup 11 a spring bias force is applied by the first portion of the elevator cup against elevator member 13, in a direction away from the product outlet 6.

Thus, the surface 14 of the elevator member pushes up the first portion of the elevator cup. At first, this first portion (inner part) 41 of the elevator cup is pushed up, and biasing is provided due to the spring element 12. Thereafter, the second portion (outer portion) 43 and the first portion 41 of the elevator cup move upward, maintaining the sealing relationship of the second portion 43 with the sides of the container 7. Therefore, the elevator cup is moved so as to force product out of the container, while still maintaining the seal between the elevator cup and container sides.

Upon rotation of the helical track 19, the followers 15 follow the serpentine path having low points **19*a* and high points 19*b*. Thus, during the generally upward movement of the elevator member 13 and elevator cup 11, a reciprocating motion is superimposed on the elevator member 13 (and, correspondingly, the elevator cup 11). Due to this reciprocating motion, and also because of the spring biasing of the elevator cup due to the spring element 12, there will also be a reciprocating motion of the first portion 41 of the elevator cup 11**.

After the consumer has dispensed a desired amount of product from the dispensing package onto, for example, applicator surface 5, there is a spring bias of the first portion of the elevator cup toward the thumb wheel, due to the spring element 12 between the first portion 41 and second portion 43 of the elevator cup 11. In view of this biasing and, moreover, in view of the serpentine path of the helical path, the first portion of the elevator cup will retract toward the thumb wheel, increasing the volume of interior chamber 9. This relieves residual pressure in the interior chamber, avoiding the weeping problem as discussed previously.

Materials for the elevator cup have previously been discussed. Conventional materials (for example, polypropylene) can be utilized for other components of the dispensing package, and standard injection molding techniques can be utilized for forming the components of the dispensing package.

As seen in the foregoing, the outlet from the interior chamber of the dispensing package permits extrusion of the product onto an applicator surface, from which the product is applied to a desired surface (for example, the skin, in axillary regions of the human body, where the product is a deodorant and/or antiperspirant cream). The outlet from the dispensing package is smaller than the cross-sectional area of the top end of container 7, providing the aforementioned extrusion of product onto the applicator surface. Moreover, the applicator surface can have any desired shape; for example, in FIGS. 1 and 2 the applicator surface 5 has a compound curved shape to facilitate application of product to the axillary region of the human body. Desirably, a foil seal is provided covering the outlet 6 to prevent undesired outflow of product from the dispenser, e.g., during shipment; such foil can then be removed by the consumer prior to first use of the dispensing package.

In the foregoing, a specific example for the pitch of the helical track is set forth, for a given diameter of rod member 21. However, the pitch of the helical track is not critical; it is related to the surface area of the top end of the container 7, the desired dosage and the specific gravity of the product. Illustratively, the pitch is such that a 15° rotation of the thumb wheel will provide ½ the desired dosage of product to be extruded onto the applicator surface.

Accordingly, through use of the helical track having the serpentine path (low and high points **19*a* and 19*b***, respectively), axial movement of the elevator, as well as axial reciprocating movement, are provided. Moreover, through use of the elevator cup having the resilient structure, a biasing of the elevator cup so as to relieve residual pressure on the product after dispensing a desired amount of product, while still maintaining desired seals between the container sides and the elevator cup, can be achieved.

Figure 12:
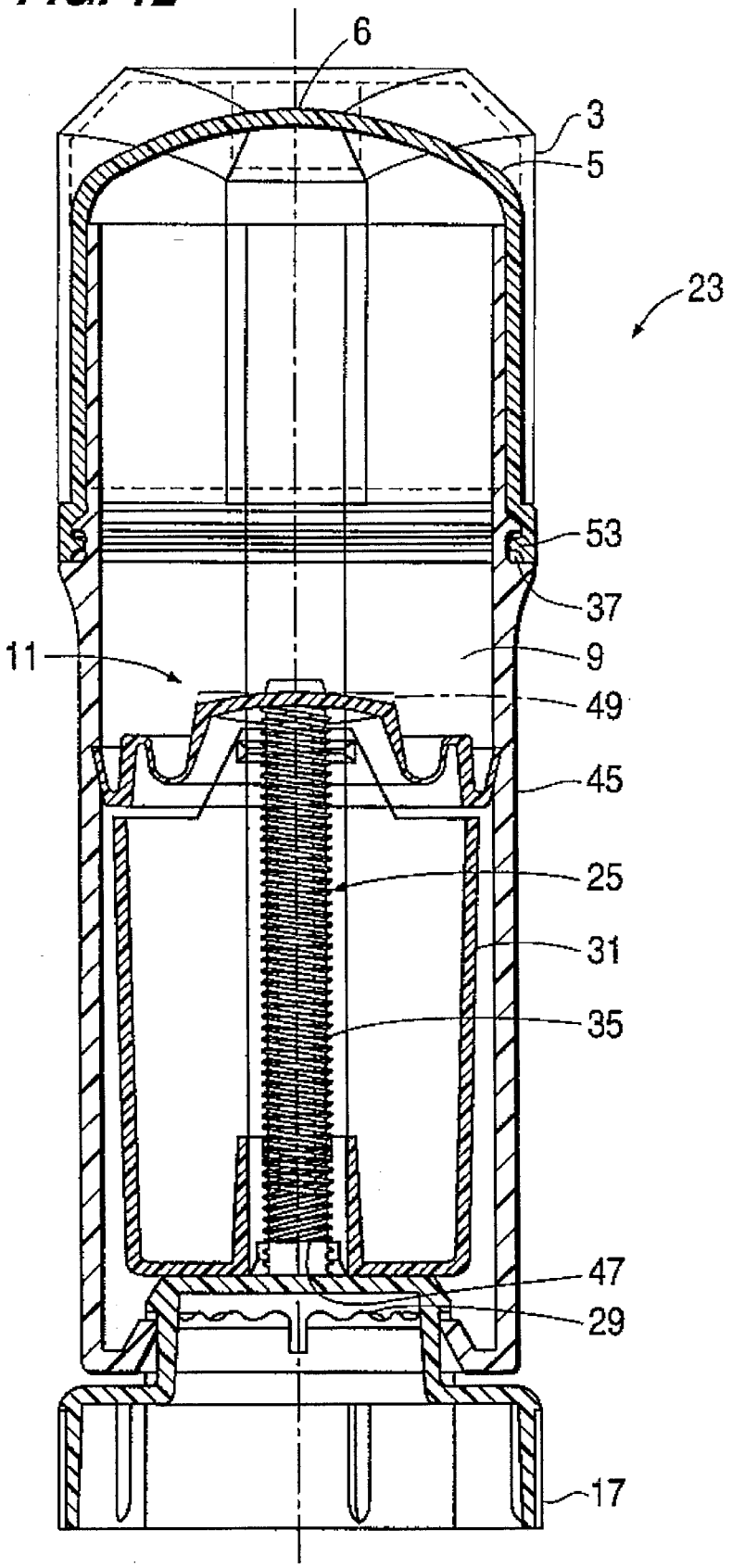
FIGS. 12 and 13 are sectional views of a second embodiment of the present invention, showing views perpendicular to each other.
Figure 13:
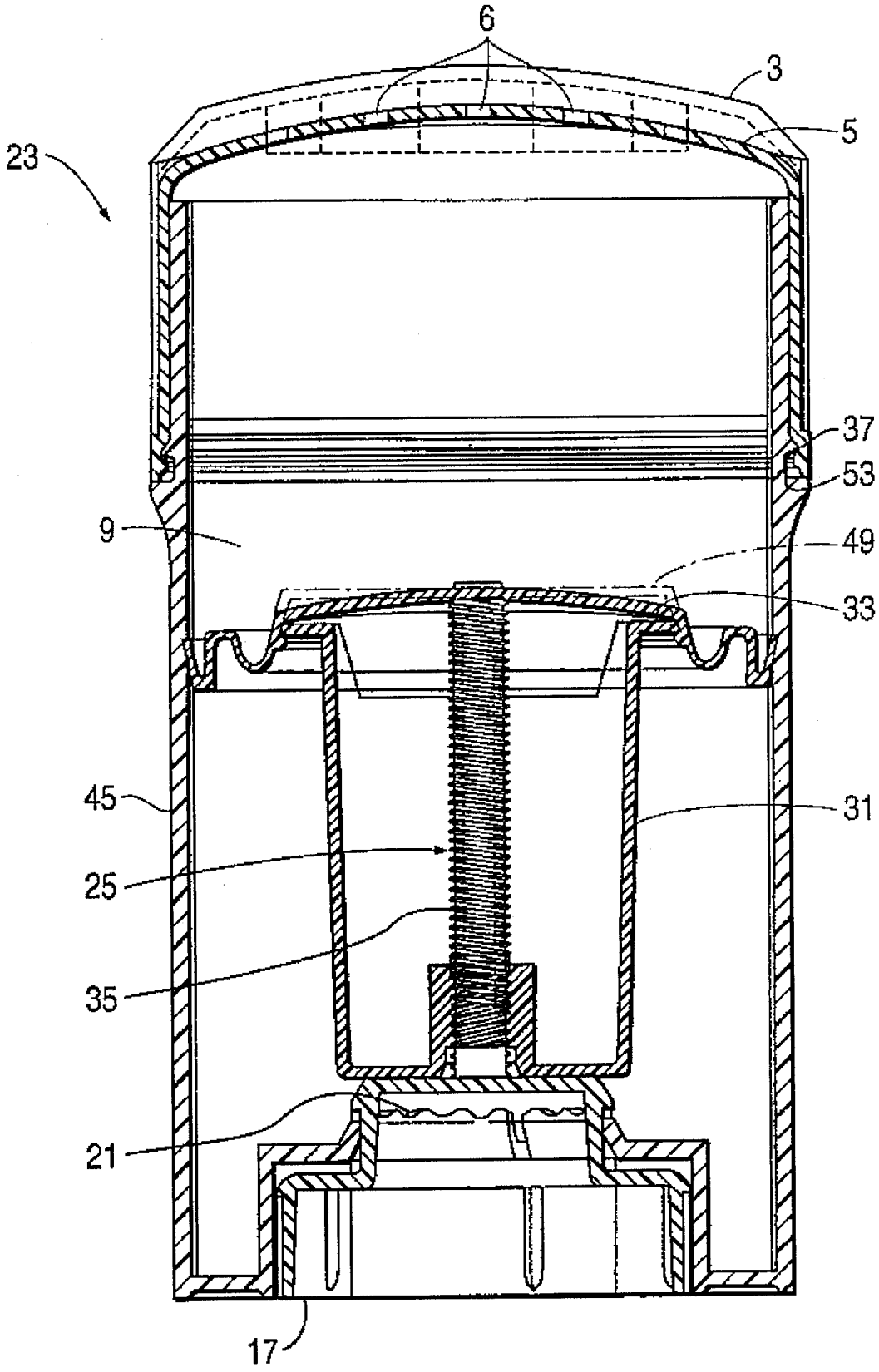
Figure 16:
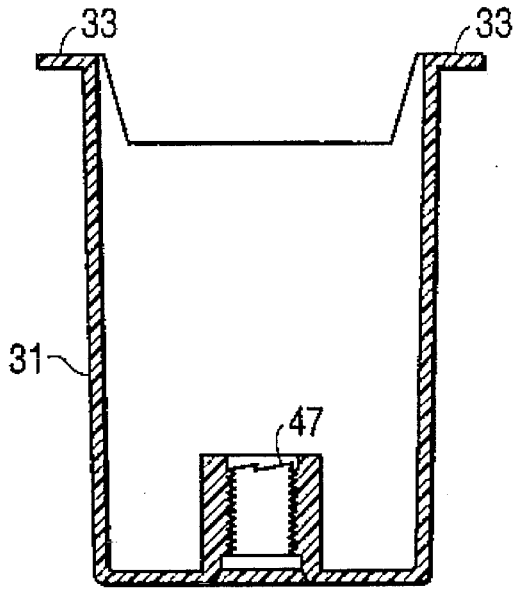
FIGS. 14–16 show the elevator member of this second embodiment of the present invention, with FIG. 14 being a top view.
Figure 14:
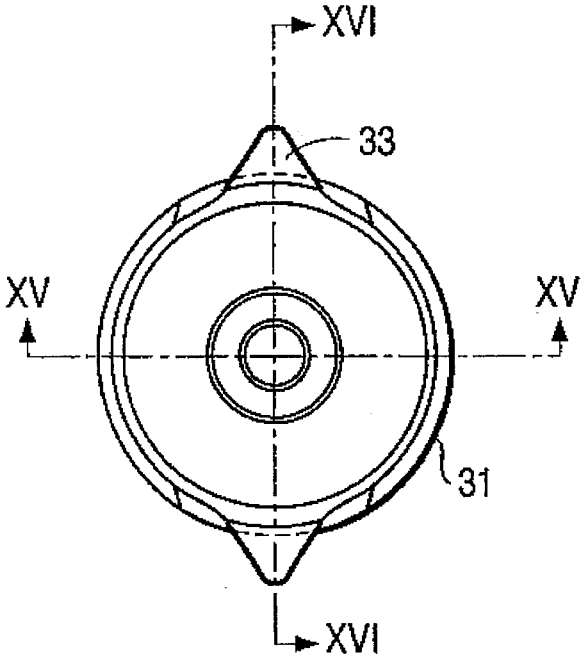
Figure 15:
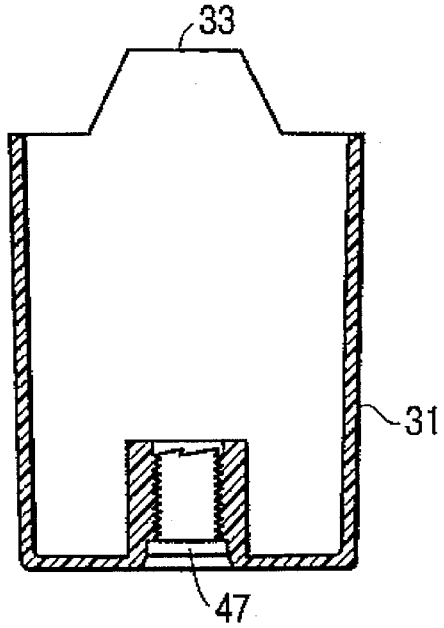

FIGS. 12–20 show a second embodiment of the present invention, with FIGS. 12 and 13 showing the dispensing package according to this second embodiment of the present invention, and FIGS. 14–20 showing details of specific components of the package. The elevator cup 11 of the second embodiment is the same as the elevator cup of the first embodiment; accordingly, reference is made to the elevator cup structure shown in FIGS. 5–8, as well as the discussion of FIGS. 5–8 in connection with the first embodiment of the present invention.

In FIGS. 12–20, components having the same function (such as cap 3) as in the first embodiment have been designated by the same reference characters, and discussion of these components for the most part will be omitted.

FIGS. 12 and 13 show, in general, dispensing package 23, having container 45 and applicator surface 5. Provided on applicator surface 5 is cap 3, which desirably is friction-fit on the applicator surface, as shown in FIGS. 12 and 13. The applicator surface 5 is snap-fit on container 45, with projection 53 on applicator surface 5 fitting into a corresponding indentation 37 in container 45, so as to avoid leakage out of interior chamber 9 between the applicator surface 5 and container 45. The applicator surface 5 has openings 6 as discussed previously, for extrusion of product from the interior chamber 9 onto the applicator surface 5. In this second embodiment, axial movement of elevator cup 11 is caused by rotating feed screw 25. Rotation of feed screw 25, having threads 35, causes axial movement of elevator member 31, having corresponding screw threads 47 thereon (see FIGS. 14–16, for details of elevator member 31). Accordingly, by rotation of thumb wheel 17 in the proper direction, the elevator member 31 can move axially so as to contact elevator cup 11 at surface 33, and then proceed to push up the first portion of the elevator cup 11 (note the dotted position 49 of the first portion of the elevator cup 11, shown in FIGS. 12 and 13) to an extended position. At such extended position, and due to the spring element 12 forming part of elevator cup 11, when the first portion is at the extended position there is a spring bias back toward the thumb wheel 17. Upon further rotation of the thumb wheel 17 driving the elevator member 31 upwards, the entire elevator member 11 will move upwards, forcing product out of interior chamber 9.

Figure 17:
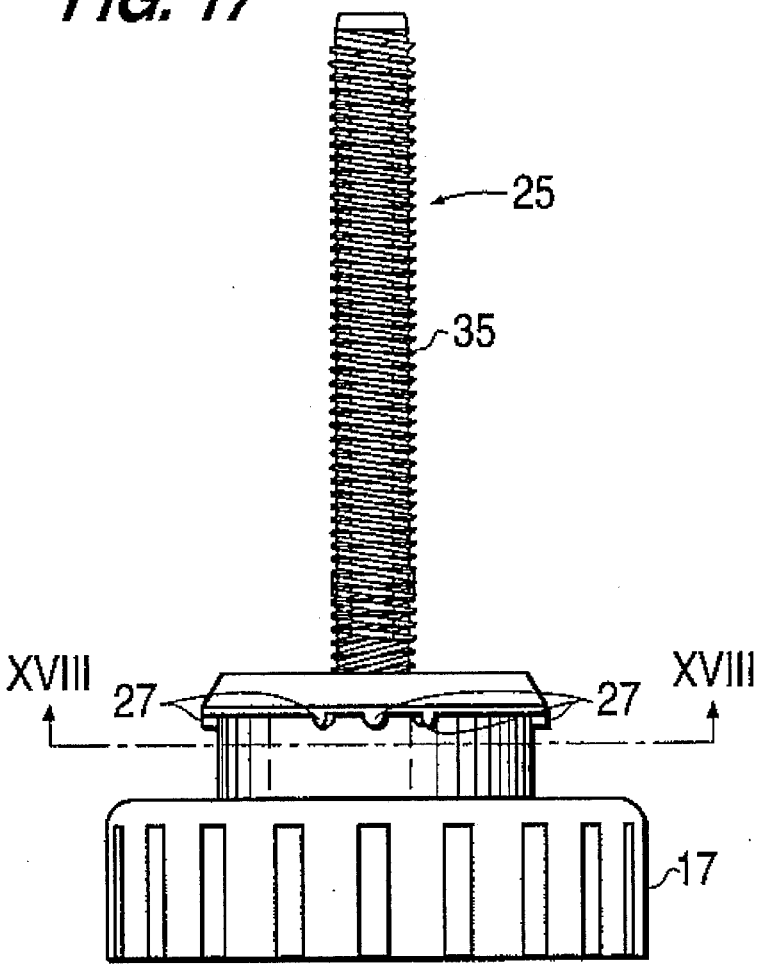
FIGS. 17 and 18 show the threaded rod and thumb wheel of the second embodiment of the present invention, with FIG. 17 being a side elevational view, and FIG. 18 being a sectional view along line XVIII—XVIII of FIG. 17.
Figure 18:
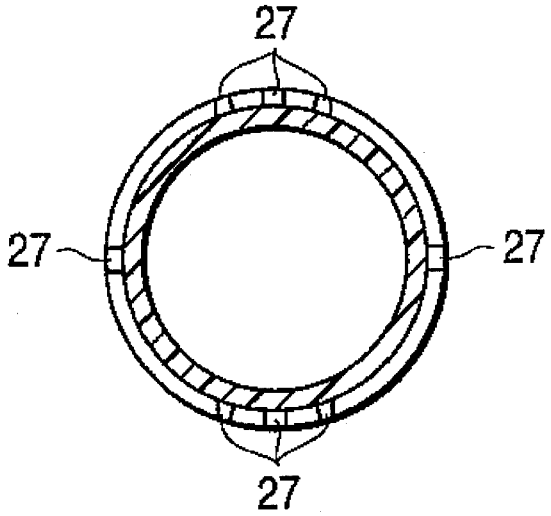
Figure 19:
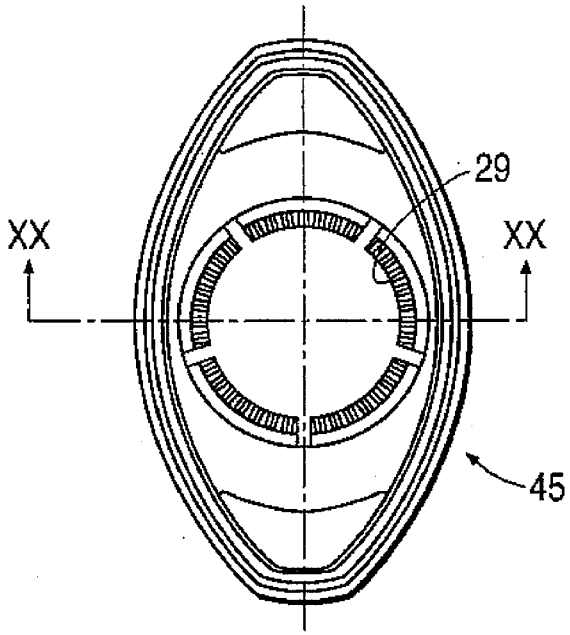
FIGS. 19 and 20 show the container body of the dispensing package according to this second embodiment of the present invention, with FIG. 19 being a top view, and FIG. 20 being a sectional view along line XX—XX of FIG. 19.
Figure 20:
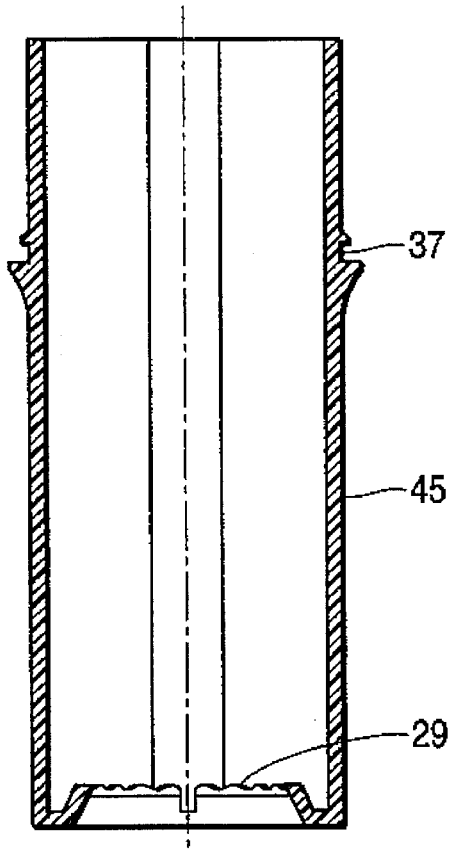

Also shown in FIGS. 12 and 13 is cam surface 29, formed as part of the bottom of the container 45 (note FIGS. 19 and 20, showing details of container 45 including the cam surface 29). As seen from FIGS. 12 and 13, the cam surface 29 is gently rounded, avoiding problems in turning the thumb wheel 17 which would occur where the cam surface is sawtoothed. As seen in FIGS. 17 and 18, followers 27 are provided in fixed relationship with the feed screw 25, for following the cam surface 29. The followers are also preferably gently rounded. Illustratively, the radius of curvature of the followers is 0.030 inch, with the radius of curvature of the cam surface being 0.030 inch and the cam surface having a period of 18°. These values for the follower and cam surface are illustrative, and not limiting of the present invention. As shown in FIG. 18, eight followers 27 are provided fixedly attached to the feed screw 25; however, the present invention is not limited to such number of followers, and can be any number, with two being a preferred minimum, as long as the followers are positioned so that all are "up" or all are "down" at the same time.

The combination of the cam surface 29 and followers 27 causes reciprocating axial motion of the feed screw (and, correspondingly, of the elevator member), the reciprocating axial motion of the elevator member being transferred to the elevator cup. The reciprocating axial motion is effectively achieved due to the aforementioned spring bias of the elevator cup. Thus, according to this embodiment, the feed screw 25 is utilized for the axial movement of the elevator cup (e.g., the forward stroke), while the separate cam structure (that is, the cam surface 29 on container 45 and followers 27 rigidly connected to the feed screw) provides the reciprocating movement.

In use, upon turning thumb wheel 17 in the appropriate direction, elevator member 31 forces the elevator cup 11 upwards in an axial direction, so as to extrude product from interior chamber 9 out through outlets 6 onto the applicator surface 5. Upon turning thumb wheel 17 and turning of feed screw 25, a spring bias arises in the elevator cup (and, correspondingly, a spring bias is applied to elevator member 31) so as to force the first portion of the elevator cup back toward the thumb wheel, due to spring element 12 of the elevator cup. Such spring bias causes the followers 27 to closely follow cam surface 29, thereby providing reciprocating axial movement of the elevator member and first portion 41 of elevator cup 11 as the followers 27 follow cam surface 29. Upon dispensing of a desired amount of the product, and due to the biasing back toward the thumb wheel caused by the resilient member of the elevator cup, the, e.g., first portion of the elevator cup will be drawn back toward the thumb wheel, relieving pressure on the product in the interior chamber and avoiding the problem of weeding as mentioned previously.

As with the first embodiment, the components can be made of materials conventionally used with similar dispensing devices. In connection therewith, note U.S. Pat. No. 5,000,356, the contents of which have previously been incorporated herein by reference. Moreover, the components of the dispensing package of the present invention can be made by conventional techniques (e.g., molding techniques), and the components can be fit together as known in the art. See, e.g., U.S. Pat. No. 5,000,356. The package according to the present invention can be filled with product, as known in the art. Furthermore, after extrusion of product onto, for example, the applicator surface, as discussed previously, the dispensing package of the present invention can be used as known in the art (for example, the product can be applied from such applicator surface to a desired surface, such as to skin in the axillary region of the human body where the product is an antiperspirant and/or deodorant product).

While I have shown and described several embodiments in accordance with the present invention, it is understood that the same is not limited thereto, but is susceptible to numerous changes and modifications as known to one having ordinary skill in the art, and I therefore do not wish to be limited to the details shown and described herein, but intend to cover all such modifications as are encompassed by the scope of the appended claims.

I claim:

1. A dispensing package, comprising:

(a) a container body having an interior chamber, for containing a product, the container body having an outlet for dispensing the product;

(b) an elevator forming a surface of the interior chamber, for forcing said product through said outlet, the elevator including an elevator cup; and (c) structure for causing the elevator cup to move so as to decrease the volume of the interior chamber, so as to force the product through the outlet;

wherein the elevator cup includes resilient structure to move the elevator thereby to increase the volume of the interior chamber from a decreased volume, after the structure for causing the elevator to move has moved the elevator to provide said decreased volume.

2. The dispensing package according to claim 1, wherein the elevator cup forms said surface of the interior chamber and contacts sides of the interior chamber, such that product in the interior chamber will not leak out of the interior chamber between the elevator cup and the sides of the interior chamber.

3. The dispensing package according to claim 2, wherein the resilient structure includes a spring element forming part of the elevator cup.

4. The dispensing package according to claim 3, wherein the spring element acts to cause the increase in volume of the interior chamber by moving a first portion of the elevator cup while a second portion of the elevator cup does not move, so as to achieve a seal between the sides of the interior chamber and the elevator cup.

5. The dispensing package according to claim 3, wherein the structure for causing the elevator to move so as to decrease the volume of the interior chamber includes a member having a helical track, whereby, upon rotation of the member, the elevator moves so as to decrease the volume of the interior chamber.

6. The dispensing package according to claim 5, wherein the helical track follows a serpentine path.

7. The dispensing package according to claim 6, wherein the elevator includes, in addition to the elevator cup, an elevator member which contacts the elevator cup at a location so as not to interfere with resiliency of the spring element, and wherein said elevator member causes movement of the elevator cup so as to decrease volume of the interior chamber.

8. The dispensing package according to claim 7, wherein the elevator member includes at least one follower for following in said helical track.

9. The dispensing package according to claim 7, wherein the elevator member contacts the elevator cup at a location thereof spaced from the sides of the interior chamber, and wherein the spring element is at a position between the sides of the interior chamber and the location where the elevator member contacts the elevator cup.

10. The dispensing package according to claim 9, wherein the interior chamber has a substantially constant cross-sectional area, and wherein the outlet has an area smaller than the cross-sectional area of the interior chamber.

11. The dispensing package according to claim 10, wherein the outlet is a series of slots on a top of the interior chamber, the elevator cup being adapted to move in a direction toward the top so as to extrude the product out of the slots.

12. The dispensing package according to claim 6, wherein the elevator includes at least one follower for following in the helical track; and wherein the serpentine path includes alternating high points and low points, the interior chamber increasing in volume as the at least one follower goes from a high point to an adjacent low point in the serpentine path of the helical track.

13. The dispensing package according to claim 3, wherein the structure for causing the elevator to move so as to decrease the volume of the interior chamber includes a feed screw, the elevator cooperating with the feed screw such that, upon rotation of the feed screw, the elevator moves so as to decrease the volume of the interior chamber.

14. The dispensing package according to claim 13, further comprising structure for reciprocatingly moving the elevator in an axial direction of the feed screw while rotating the feed screw.

15. The dispensing package according to claim 14, wherein said structure for reciprocatingly moving the elevator moves said feed screw reciprocatingly.

16. The dispensing package according to claim 14, wherein said structure for reciprocatingly moving the elevator includes a cam and at least one follower, the cam or the at least one follower being rotatable with the feed screw, and the other of the cam and at least one follower being non-rotatable with the feed screw, whereby the cam or the at least one follower rotates with the feed screw and the other of the cam and the at least one follower does not rotate with the feed screw, with the cam and the at least one follower being biased toward each other by the spring element.

17. The dispensing package according to claim 1, further comprising structure for reciprocatingly moving the elevator so as to increase and decrease volume of the interior chamber while the elevator is moved by said structure for causing the elevator to move so as to decrease the volume of the interior chamber, whereby the volume of the interior chamber can be increased upon moving the structure for causing the elevator to move.

18. The dispensing package according to claim 17, wherein the structure for reciprocatingly moving the elevator includes a cam and at least one follower, and a movable member, the cam or the at least one follower being movable with the movable member for causing the elevator to move, and the other of the cam and the at least one follower not moving with the movable member for causing the elevator to move, whereby the cam and the at least one follower are movable relative to each other.

19. The dispensing package according to claim 18, wherein the cam has a rounded surface so as to facilitate movement of the at least one follower thereon.

20. The dispensing package according to claim 18, wherein the cam and the at least one follower are biased toward each other by the resilient structure.

21. The dispensing package according to claim 1, wherein the resilient structure is an integral part of the elevator cup.

22. The dispensing package according to claim 1, wherein the elevator includes, in addition to the elevator cup, an elevator member which contacts the elevator cup at a location so as not to interfere with resiliency of the resilient structure and causes movement of the elevator cup so as to decrease volume of the interior chamber.

23. The dispensing package according to claim 22, wherein the elevator member contacts the elevator cup at a location spaced from sides of the interior chamber, and wherein the resilient structure is at a position between the sides of the interior chamber and the location where the elevator member contacts the elevator cup.

24. A packaged product comprising the dispensing package according to claim 23, with a product in the interior chamber, the product being a flowable viscous material.

25. A packaged product comprising the dispensing package according to claim 18, with a product in the interior chamber, the product being a flowable viscous material.

26. A packaged product comprising the dispensing package according to claim 16, with a product in the interior chamber, the product being a flowable viscous material.

27. A packaged product comprising the dispensing package according to claim 12, with a product in the interior chamber, the product being a flowable viscous material.

28. A packaged product comprising the dispensing package according to claim 11, with a product in the interior chamber, the product being a flowable viscous material.

29. A packaged product comprising the dispensing package according to claim 1, with a product in the interior chamber, the product being a flowable viscous material.

30. The packaged product according to claim 29, wherein the flowable viscous material has a viscosity in the range of 500,000 to 2,000,000 cps.

31. The packaged product according to claim 29, wherein the flowable viscous material is a cream product.

32. The packaged product according to claim 31, wherein the cream product is a deodorant or antiperspirant cream, for application to axillary regions of the human body.

33. The dispensing package according to claim 1, wherein structure to move the elevator thereby to increase the volume of the interior chamber consists of the resilient structure included in said elevator cup.

34. The dispensing package according to claim 1, wherein structure to move the elevator thereby to increase the volume of the interior chamber consists essentially of the resilient structure included in said elevator cup.

35. The dispensing package according to claim 1, wherein said elevator cup includes first and second portions, and said resilient structure is between the first and second portions.

36. The dispensing package according to claim 35, wherein the resilient structure provides a spring biasing action to said first portion, in a direction away from said outlet, so as to move the elevator thereby to increase the volume of the interior chamber.

37. The dispensing package according to claim 35, wherein the resilient structure is integral with the first and second portions of the elevator cup.

38. The dispensing package according to claim 37, wherein the resilient structure is a U-shaped part of the elevator cup.

39. The dispensing package according to claim 35, wherein the elevator includes, in addition to the elevator cup, an elevator member which contacts the elevator cup at a location so as not to interfere with resiliency of the resilient structure, and wherein said elevator member causes movement of the elevator cup so as to decrease volume of the interior chamber.

40. The dispensing package according to claim 39, wherein said elevator member contacts said first portion.

41. The dispensing package according to claim 1, wherein the resilient structure provides a spring biasing action to the elevator in a direction away from said outlet so as to move the elevator thereby to increase the volume of the interior chamber from said decreased volume.

42. The dispensing package according to claim 41, wherein the elevator includes, in addition to the elevator cup, an elevator member which contacts the elevator cup at a location so as not to interfere with resiliency of the resilient structure, and wherein said elevator member causes movement of the elevator cup so as to decrease volume of the interior chamber.

43. The dispensing package according to claim 4, wherein said second portion of the elevator cup is a portion adjacent the sides of the interior chamber.

44. A method of dispensing a product from a dispensing package, the dispensing package having an interior chamber holding the product, an elevator of the dispensing package forming a surface of the interior chamber and being movable so as to decrease the volume of the interior chamber so as to force product out of the dispensing container, the elevator having a resilient structure forming part of said surface and having a first portion and a second portion, the method comprising the steps of:

(a) moving the elevator to decrease the volume of the interior chamber, so as to force product out of the dispensing package, whereby the interior chamber has a decreased volume, the first portion of the elevator moving a greater distance than said second portion in providing said decreased volume; and (b) stopping said moving the elevator, the resilient structure of the elevator then forcing the first portion to move so as to provide the interior chamber with a greater volume than said decreased volume.

45. The method according to claim 40, wherein said interior chamber is cylindrical and said elevator extends between sides of the interior chamber, contacting the sides; and wherein the first portion of the elevator is a central portion thereof and the second portion contacts the sides of the interior chamber, the resilient structure extending between the first and second portions.

* * * * *

UNITED STATES PATENT AND TRADEMARK OFFICE

CERTIFICATE OF CORRECTION

PATENT NO. : 5,540,361

DATED : July 30, 1996

INVENTOR(S) : Joseph E. Fattori

It is certified that error appears in the above-indentified patent and that said Letters Patent is hereby corrected as shown below:

Title page, left-hand column, the title "CREAM DEDORANT DISPENSER" should read --CREAM DEODORANT DISPENSER--, and in column 1 of printed patent, the title "CREAM DEDORANT DISPENSER" should read --CREAM DEODORANT DISPENSER--.

Signed and Sealed this

Fifth Day of November, 1996

*Attest:*

Bruce Lehman

BRUCE LEHMAN

*Attesting Officer*

*Commissioner of Patents and Trademarks*